United States Patent [19]

Ascarrunz

[11] Patent Number: 5,064,107

[45] Date of Patent: Nov. 12, 1991

[54] TENNIS BALL HOLDER

[75] Inventor: Douglas D. Ascarrunz, Templeton, Calif.

[73] Assignee: EWT Corporation, Irvine, Calif.

[21] Appl. No.: 113,466

[22] Filed: Oct. 23, 1987

[51] Int. Cl.[5] ..... A63B 71/00

[52] U.S. Cl. ..... 224/247; 224/253; 224/919

[58] Field of Search ..... 224/252, 253, 919, 251, 224/224, 247, 225, 249; 206/315.9; 211/14; 221/309

[56] References Cited

U.S. PATENT DOCUMENTS

| | | | |
|---|---|---|---|
| 1,718,952 | 7/1929 | Fischer | 206/315.9 |
| 1,911,256 | 5/1933 | Andrew | 224/252 X |
| 3,865,290 | 2/1975 | Sperling | 224/919 X |
| 3,963,157 | 6/1976 | Truax et al. | 224/253 |
| 3,968,875 | 7/1976 | Koehnk | 206/315.9 |
| 4,026,449 | 5/1977 | Kevin | 211/14 X |
| 4,042,156 | 8/1977 | Knight | 224/253 |
| 4,079,871 | 3/1978 | Sica | 224/919 X |
| 4,151,936 | 5/1979 | Hawkes | 224/919 X |
| 4,299,345 | 11/1981 | Lanzl | 224/252 |
| 4,416,404 | 11/1983 | Daniels | 224/224 |
| 4,433,803 | 2/1984 | Lieberboim | 224/919 X |
| 4,632,245 | 12/1986 | Lerner | 206/315.9 X |
| 4,706,860 | 11/1987 | Leider | 224/247 |

FOREIGN PATENT DOCUMENTS

| | | | |
|---|---|---|---|
| 1294937 | 4/1962 | France | 224/919 |

*Primary Examiner*—Renee S. Luebke

*Attorney, Agent, or Firm*—Arthur Freilich; Robert D. Hornbaker; Leon D. Rosen

[57] ABSTRACT

A device is provided that can be carried by a tennis player, which allows the player to easily store and receive tennis balls. The device includes a substantially rigid tubular member whose inside closely surrounds a standard size tennis ball, and which has a wide slot at one side through which a tennis ball can pass when resiliently deformed. With the tubular member at the player's back at waist level, the player can place a ball anywhere against the slot and press the ball through the slot into the tubular member, or reach through the slot to grasp a ball and pull it out through the slot or through an open end of the tubular member.

2 Claims, 1 Drawing Sheet

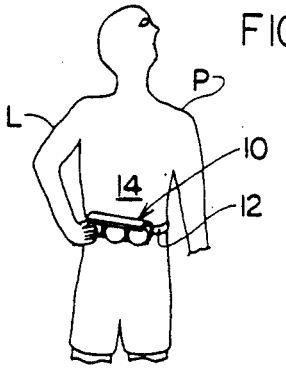
FIG. 1
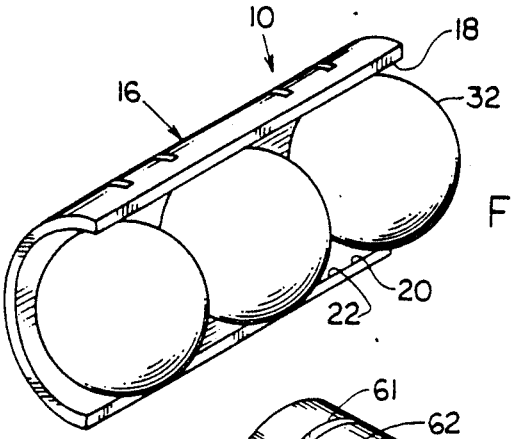
FIG. 2
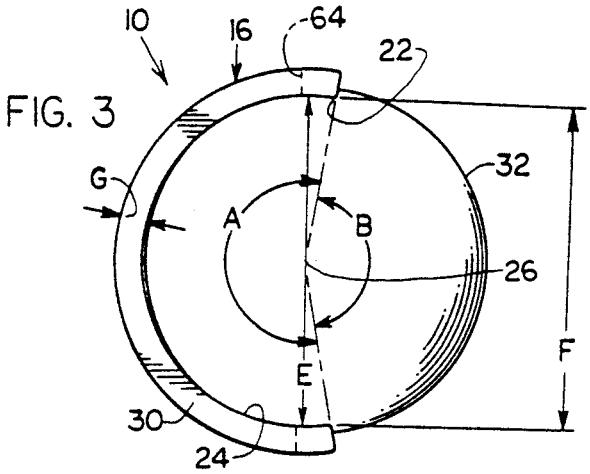
FIG. 3
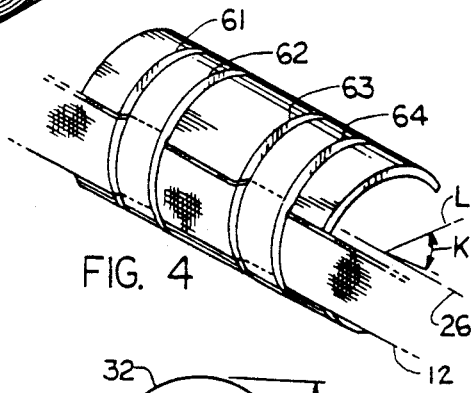
FIG. 4
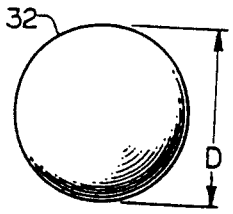
FIG. 6
FIG. 5
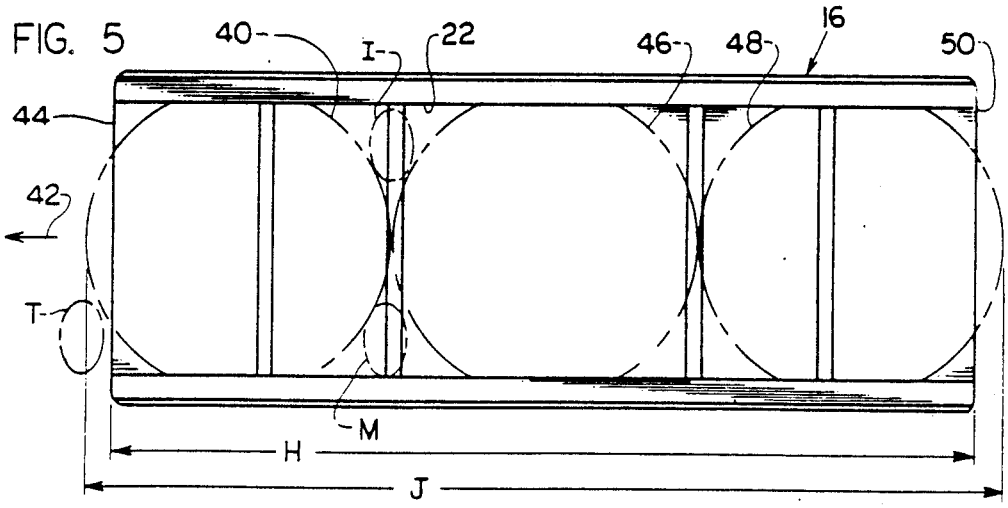

TENNIS BALL HOLDER

BACKGROUND OF THE INVENTION

Tennis players often store and retrieve tennis balls from their pockets, but the awkward feeling and appearance makes this undesirable. Containers have been proposed for mounting at the waist of the player, which include tubes with open ends through which the ball can pass, and with resilient stops at the ends to prevent the ball from falling out. The devices generally have to be worn at the front of the player to enable him to locate the ball at the open end of the tube. A holder positioned in front of the player is somewhat "in the way" in that the player's arm may brush against the holder during play, and because the presence of a holder in front of a person can be distracting. A tennis ball holder that could be mounted at the rear of a person's waist, and which permitted the person to easily locate portions of the holder through which a tennis ball can be inserted for storage and removed for play, and which was of simple and rugged design to assure high reliability, would be of considerable value.

SUMMARY OF THE INVENTION

In accordance with one embodiment of the present invention, a simple and reliable apparatus is provided, that can be carried by a tennis player to receive and dispense tennis balls with great ease. The apparatus includes a substantially rigid elongated tubular member which can closely surround tennis balls. The tubular member has walls forming a slot extending along its length, which is preferably slightly narrower than a tennis ball by an amount that enables the ball to be forced by hand through the slot into the tubular member, by compression of the ball by the walls of the slot. When the holder is mounted on the back of a tennis player, the player can press a ball towards the device and feel it nesting in the slot before the player forces the ball through the slot. The player then presses the ball through the slot into the tubular member where it is securely held. One or both ends of the tubular member can be open to allow balls to move through the open end.

One holder is formed from a rigid tube of an inside diameter slightly less than that of standard size tennis balls. The slot extends by slightly less than one half circle, such as about 160°, so there is a moderately high resistance to passage of the ball through the slot, and a lower resistance of movement of the ball along the tube.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of the rear of a tennis player, showing a tennis ball holder of the present invention being worn by the player.

FIG. 2 is a front perspective view of the tennis ball holder of FIG. 1, but without the strap thereon.

FIG. 3 is an end view of the holder of FIG. 2.

FIG. 4 is a rear perspective view of the holder of FIG. 2 showing how a belt is coupled thereto.

FIG. 5 is a front elevation view of the holder of FIG. 2.

FIG. 6 illustrates a tennis ball that can be stored in the holder of FIG. 3.

DESCRIPTION OF THE PREFERRED EMBODIMENT

FIG. 1 illustrates a tennis ball holder 10 held by a waist band 12 to the back-waist region 14 of a tennis player P. When the player holds a tennis racket in his right hand, he can reach around with his left hand L to store a tennis ball in the holder or to retrieve one therefrom. As shown in FIG. 2, the holder includes a substantially rigid elongated tubular member 16 whose inside closely surrounds standard size tennis balls. The tubular member has walls 18, 20 forming a slot 22 that extends along the length of the tubular member. The slot is slightly narrower than a standard size tennis ball, by an amount that enables the ball to be forced by hand through the slot into the tubular member, by compression of the ball by the walls 18, 20 of the slot.

As shown in FIG. 3, the tubular member 16 has a largely cylindrical inside surface 24 which is centered on an axis 26, and which extends by an angle A of slightly more than one half circle about the axis. Accordingly, the slot 22 extends by an angle B of slightly less than one half circle. The walls 30 of the tubular member are rigid, as compared to the resilience of a tennis ball, so that it is the resilience of a tennis ball that holds it in place. FIG. 3 shows the ball deformed slightly inasmuch as the inside diameter E of the tubular member and the width of the slot F in the tubular member, are smaller than the outside diameter D of the ball.

A standard size tennis ball 32 has an undeflected diameter D of approximately 2.54 inches. Applicant has constructed a holder of the construction illustrated, having an inside diameter E of 2.34 inches, which is about 0.2 inch less than the diameter of the unsqueezed ball. The tube extends by an angle A of 200°, leaving a slot angle B of 160° and a slot width F of 2.31 inches. The tubular member 16 was formed of acrylic plastic with a wall thickness G of 0.225 inch to provide a substantially rigid tube. Applicant found that he required a force of 9 pounds to push the ball through the slot into or out of the tubular member, and a force of about 3 pounds to move the ball along the axis or length of the tubular member. It should be noted that a typical tennis ball includes a rubber or other elastomeric shell covered by cloth-like fibers. Initial compression of the ball involves largely compression of the fibers which provide only low resistance, while further compression of the ball involves compression of the rubber shell which involves somewhat higher resistance to compression. The holder is designed to lie with its length and the slot extending primarily horizontally. The upper and lower walls of the tubular member (at the ends of arrows E in FIG. 3) are in interference fit with the tennis ball.

The holder 16 shown in the figures is designed to hold three tennis balls, and has a length H (FIG. 5) of $7\frac{1}{4}$ inch. Applicant has also constructed a longer holder designed to hold five balls. In the holder 16, when three balls are in place as shown in FIG. 5, the player can reach behind his back with his left hand and grasp a first ball 40 with his thumb T, index finger I and middle finger M positioned as shown in the figure (or use only his thumb and index finger) to slide the ball in the direction of arrow 42 out of the open end 44 of the holder. The next ball 46 can be removed by similarly grasping the ball, and by sliding it not only in the direction of arrow 42, but also rearwardly away from the wearer's back, to remove the ball through the slot 22. The third ball 48 is also most easily removed through the slot. The balls are most easily replaced by merely pressing them directly through the slot 22. The player can easily feel the wide slot 22 by the "nesting" of the ball in the slot and/or by feeling the presence of the slot with his hand. The player's hand can feel the rightmost end 50 of the slot to place the first ball 48 thereat, and can use his hand to feel the position of the balls already in place to place the next ball beside the previous ball.

The fact that the player can readily feel the position of the wide slot with respect to the ball, while the holder lies at the player's back, facilitates rapid insertion of the balls into the holder. By allowing the holder to lie at the back of the player's waist, applicant avoids the distraction and possible interference of the holder with the player's movements during the playing of a game, where the player's arm may swing closely across his front or right side (for a right-handed player). Of course, the holder can be positioned at the front or side of the player if the player so desires.

The fact that the holder is constructed of a simple tubular member, without the need for spring clips along its length or resilient barriers at the end, results in the holder being very simple, of low cost, and attractive in appearance, and also being rugged. The fact that the balls are held in interference fit in the tube, allows the tubular member of length H to be less than the length J of a stack of balls that can be securely held in the tubular member, as well as prevent ball movement, in a simple device.

The waist band 12 can be mounted on the tubular member 16, as shown in FIG. 4, by extending the belt through two pairs of slots 61–66 formed in the tubular member, which extend by about 180° about the axis of the member. The slots are wider than the waist band to allow the middle of the slot to extend at a downward angle K from the horizontal L, which makes access to the holder slightly easier.

Thus, the invention provides an apparatus that can be carried by a tennis player to receive and dispense tennis balls. The apparatus includes a substantially rigid elongated tubular member whose inside closely surrounds standard size tennis balls. The tubular member has walls forming a slot that preferably extends along the entire length of the tubular member, with the slot being slightly narrower than the tennis balls by an amount that enables the balls to be pressed by hand through the slot into the tubular member primarily by compression of the balls by the walls of the slot. The tubular member has an inside that preferably has an interference fit with the tennis balls to hold them in place; the tubular member can be formed with a cylindrical inner surface of a diameter slightly smaller than the diameter of a tennis ball. The ends of the tubular member are preferably open, and devoid of obstructions to the passage of balls through the ends, to enable balls to easily move through an open end.

Although particular embodiments of the invention have been described and illustrated herein, it is recognized that modifications and variations may readily occur to those skilled in the art and consequently it is intended to cover such modifications and equivalents.

What is claims is:

1. Apparatus that can be carried by a tennis player to receive and dispense elastic tennis balls of a predetermined size, comprising:

a rigid substantially cylindrical tube having an axis and having open ends and a slot extending along the length of said tube, said tube having an inside diameter slightly less than said ball predetermined size, to resiliently compress said tennis balls while they lie in the tube, and said open ends being devoid of obstructions to the passage of balls therethrough.

2. Apparatus that can be carried by a tennis player to receive and dispense standard size elastic tennis balls, comprising:

a substantially rigid elongated tubular member whose inside closely surrounds standard size tennis balls, said tubular member having walls forming a slot along its length which is slightly narrower than said standard size tennis balls by an amount that enables the balls to be forced by hand through the slot into the tubular member by compression of the balls by the walls of the slot;

a waist band that can fasten around the waist of the tennis player, and means for holding said tubular member to said band to hold said tubular member at the rear of the tennis player;

said tubular member having an axis and said slot having a middle lying halfway between said walls forming said slot;

said holding means formed to hold said tubular member so that an imaginary line extending between said axis and the middle of said slot extends at a downward angle from horizontal.

* * * * *